US005092126A

United States Patent [19]

Yano

[11] Patent Number: 5,092,126

[45] Date of Patent: Mar. 3, 1992

[54] TWIN SCROLL TURBINE

[75] Inventor: Shunji Yano, Saitama, Japan

[73] Assignee: Honda Giken Kogyo Kabushiki Kaisha, Tokyo, Japan

[21] Appl. No.: 310,238

[22] Filed: Feb. 13, 1989

[30] Foreign Application Priority Data

Mar. 8, 1988 [JP] Japan ..... 63-054333

[51] Int. Cl.[5] ..... F02B 37/12

[52] U.S. Cl. ..... 60/602; 415/164

[58] Field of Search ..... 60/602; 415/163, 164

[56] References Cited

FOREIGN PATENT DOCUMENTS

| | | | |
|---|---|---|---|
| 176417 | 10/1983 | Japan | 60/602 |
| 105032 | 7/1984 | Japan . | |
| 122726 | 7/1984 | Japan . | |
| 19920 | 2/1985 | Japan | 60/602 |
| 126224 | 6/1987 | Japan | 60/602 |
| 230923 | 9/1988 | Japan | 60/602 |

*Primary Examiner*—Michael Koczo

*Attorney, Agent, or Firm*—Lyon & Lyon

[57] ABSTRACT

A radial turbine combining a twin scroll structure and a variable area nozzle structure which is suitable for use as the exhaust turbine of a turbocharger for an automotive internal combustion engine. The first scroll passage is provided with no flow control means while the second scroll passage is provided with a variable area nozzle unit so that only the first scroll passage is used with the second scroll passage substantially closed in low speed range of the engine and the variable area nozzle unit is activated only when the rotational speed of the engine is increased beyond a certain value. Alternatively, by providing a control valve in the first scroll passage, it is possible to adjust the variable area nozzle unit with the control valve kept closed in low speed range, and to open up both the variable area nozzle unit and the control valve in high speed range. In either case, the turbine is capable of finely adjusting the operating condition thereof without creating excessive back pressure at its inlet end or involving any shocks or lags over the whole speed range.

6 Claims, 3 Drawing Sheets

TWIN SCROLL TURBINE

TECHNICAL FIELD

The present invention relates to a variable capacity turbine having a pair of scroll passages leading to a common turbine wheel, and in particular to such a turbine which can favorably operate over a wide range of fluid flow rate substantially without any discontinuity in its operation.

BACKGROUND OF THE INVENTION

A radial turbine, when it is used as the exhaust turbine of a turbocharger as often is the case, can accomplish a high degree of supercharging even when the speed of the exhaust gas entering the turbine is low by reducing the size of the nozzles defined adjacent to the periphery of the turbine wheel to a small value and thereby increasing the speed of the exhaust gas flow directed to the turbine wheel. On the other hand, in high speed range, narrowing the nozzles causes the efficiency of the engine to drop because the resistance to the flow of the exhaust gas increases and a considerable back pressure is created in the exhaust system of the engine.

Such a property of the radial turbine for a turbocharger is characterized by the ratio of the cross-sectional area A of the throat section of the scroll passage to the distance R between the center of the cross-section and the center of the turbine wheel. When this ratio A/R is small, the speed of the exhaust gas directed to the turbine wheel is accelerated and a high degree of supercharging is possible even in low speed range, but a significant back pressure is produced in the exhaust system in high speed range. On the other hand, when this ratio A/R is large, the turbine produces a relatively low back pressure even in high speed range but the speed of the exhaust gas directed to the turbine wheel is relatively so low in low speed range that a sufficient degree of supercharging is possible only in a relatively high speed range.

To overcome this problem, it has been disclosed in Japanese Utility Model Laid-Open Publication No. 59-105032 and Japanese Patent Laid-Open Publication No. 59-122726 to use a pair of parallel scroll passages leading to a common turbine wheel and selectively closing the inlet end of one of the scroll passages to reduce the A/R ratio when the flow rate of the incoming fluid is small. When the flow rate of the incoming fluid is large, the two scroll passages are both used so as to increase the A/R ratio. However, according to this twin scroll turbine structure, the range of A/R ratio variation is small because the turbine is only usable in either the low speed setting where only one of the scroll passages is used or the high speed setting where both the scroll passages are used, without any intermediate setting, when a reasonable efficiency of the turbine is to be ensured. Furthermore, the transition between the two different states of the setting is carried out in a step-wise manner, and the abrupt change in the operation condition of the turbine tends to cause an undesirable shock.

BRIEF SUMMARY OF THE INVENTION

A primary object of the present invention is to provide a variable capacity turbine with an increased range of fluid speed control.

A second object of the present invention is to provide a twin scroll turbine which is capable of high precision control even when the flow rate of the fluid is small, and involves a relatively small resistance loss when the flow rate is large.

A third object of the present invention is to provide such a twin scroll turbine which involves substantially no shock in the transition from the two different states of operation.

These and other objects of the present invention can be accomplished by providing a variable capacity turbine, comprising: a casing defining a first scroll passage, a second scroll passage having a central part which is common to the first scroll passage, and an axial passage communicated with the common central part of the scroll passages; a turbine wheel rotatably arranged in the common central part of the scroll passages; and a plurality of variable area nozzles arranged in a part of the second scroll passage adjacent to and surrounding the common central part.

According to a certain concept of the present invention, the variable area nozzles are placed in a minimally open or substantially closed state so that the working fluid may be directed substantially only through the first scroll passage when the flow rate of the working fluid is less than a certain prescribed value, and the size of the variable area nozzles is adjusted according to the flow rate of the working fluid so that the working fluid may be directed through both the first and second scroll passages when the flow rate is greater than the prescribed value.

According to another concept of the present invention, the first scroll passage is substantially closed by a control valve and the size of the variable area nozzles is adjusted according to the flow rate of working fluid so that the working fluid may be directed substantially only through the second scroll passage when the flow rate of the working fluid is less than a certain prescribed value, and the control valve is opened up and the variable area nozzles are kept in a maximally open or substantially open state so that the working fluid may be directed through both the first and second scroll passages when the flow rate is greater than the prescribed value.

In either case, the turbine is made capable of finely adjusting the operating condition thereof without creating excessive back pressure at its inlet end or involving any shocks or lags over the whole speed range.

The present invention finds a particularly suitable application in the exhaust turbine of a turbocharger for an automotive internal combustion engine which requires a quick and smooth response and an extremely wide range of operating condition.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
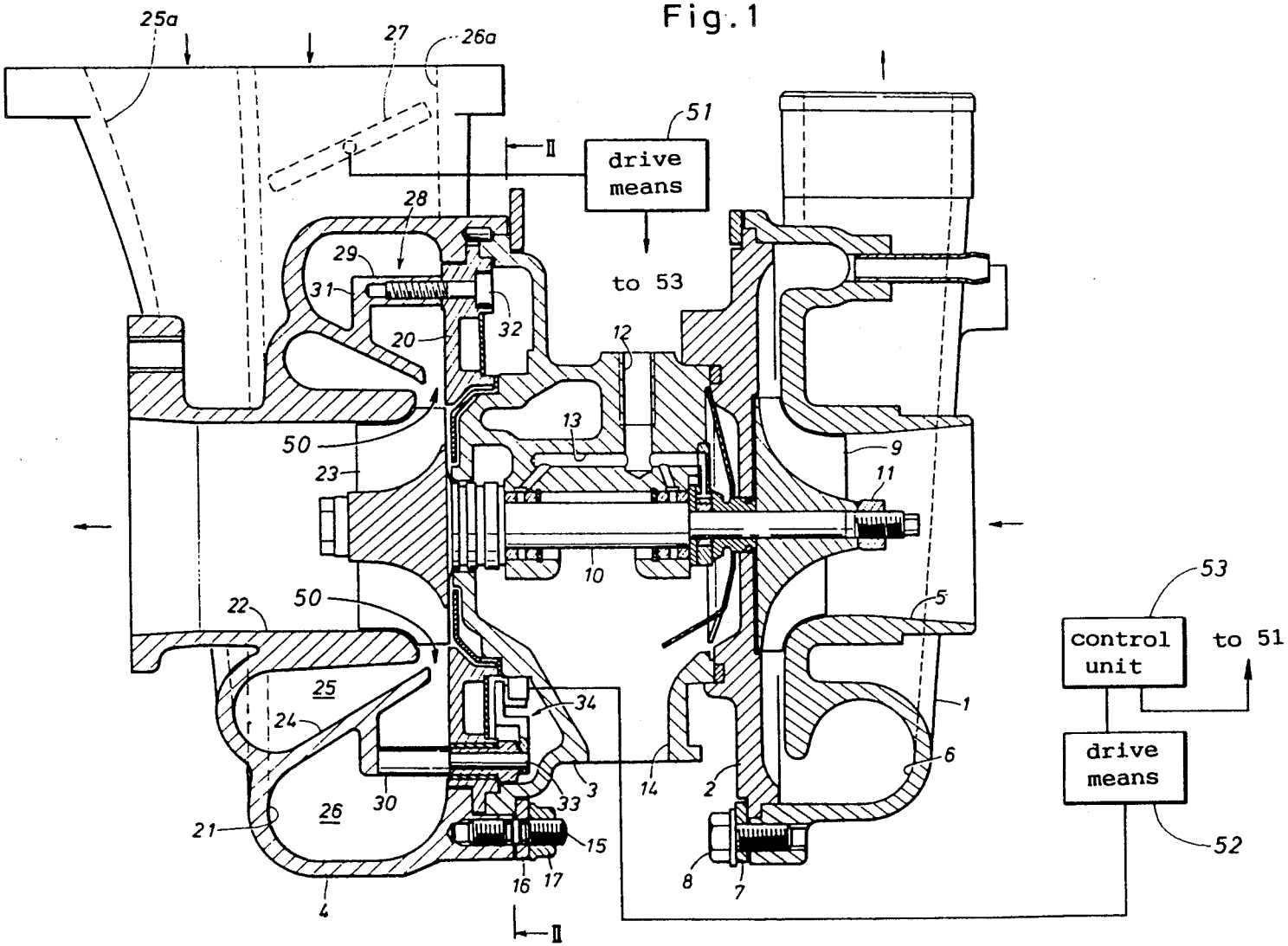
FIG. 1 is a sectional view of a turbocharger to which the present invention is applied.

FIG. 1 shows a turbocharger for an internal combustion engine to which the twin scroll turbine of the present invention is applied. This turbocharger is provided with a compressor casing 1 accommodating a compressor unit for compressing the intake of an engine not shown in the drawings, a back plate 2 which closes the rear of the compressor casing 1, a lubrication unit casing 3 for rotatably supporting the main shaft 10 of the turbocharger and lubricating the bearings for the main shaft 10, and a turbine casing 4 accommodating a turbine unit which is driven by exhaust gas from the engine to supply rotary power to the compressor unit via the main shaft 10.

The compressor casing 1 internally defines an intake inlet passage 5 which opens out in the axial direction, and a scroll passage 6 serving as the outlet for the intake, and is integrally joined to the back plate 2 by means of threaded bolts 8 with a ring member 7 interposed therebetween. In the center of the scroll passage 6 is arranged a compressor wheel 9 so as to adjoin the internal end of the intake inlet passage 5. The compressor wheel 9 is integrally attached to an end of the main shaft 10 by means of a nut 11, the main shaft 10 being rotatably supported in the center of the lubrication unit casing 3.

The lubrication unit casing 3 is connected to the center of the back plate 2. The upper part of the lubrication unit casing 3 is provided with a lubrication oil introduction hole 12, from which the lubrication oil, supplied by a lubrication oil pump not shown in the drawings, is fed to various parts of the bearings for the main shaft 10 via a lubrication oil passage 13, and is expelled from an outlet 14 provided in a lower part of the lubrication unit casing 3. To avoid the lubrication oil from entering the compressor unit, known sealing means such as a shield plate and so on is interposed between the back plate 2 and the lubrication unit casing 3.

The turbine casing 4 is integrally attached to the other end of the lubrication unit casing 3, along with a back plate 20, by threading nuts 17 to stud bolts 15 which are in turn threaded into the rear end of the turbine casing 4, with a ring member 16 interposed between a mounting flange of the lubrication unit casing 3 and the nuts 17. The interior of the turbine casing 4 defines an annular scroll passage 21 which consists of a first scroll passage 25 and a second scroll passage 26 separated from each other by a partition wall 24. An exhaust gas outlet 22 extends axially from a common central part of the first and second scroll passages 25 and 26 and in which the turbine wheel 23 is located. The first scroll passage 25 is designed for fixed flow capacity with its cross-sectional area progressively diminishing from its inlet **25*a* to the central part of the turbine casing 4 accommodating a turbine wheel 23, without involving any variable flow control means. On the other hand, the second scroll passage 26 is provided with a control valve 27 at its inlet 26*a* for controlling the flow of the exhaust gas entering the second scroll passage 26. The cross-sectional area of the second scroll passage 26 likewise progressively diminishes from its inlet 26*a* to the central part of the turbine casing 4 as it extends in parallel with the first scroll passage 25. The control valve 27 is adapted to be actuated by external drive means 51 which is in turn controlled by a control unit 53. The central portion of the second scroll passage 26 adjoining the outer periphery of the turbine wheel 23, externally of a throat section 50 defined as an annular region having a locally minimum cross section in the central part of the scroll passage 21 is provided with an annular variable area nozzle unit 28**.

Figure 2:
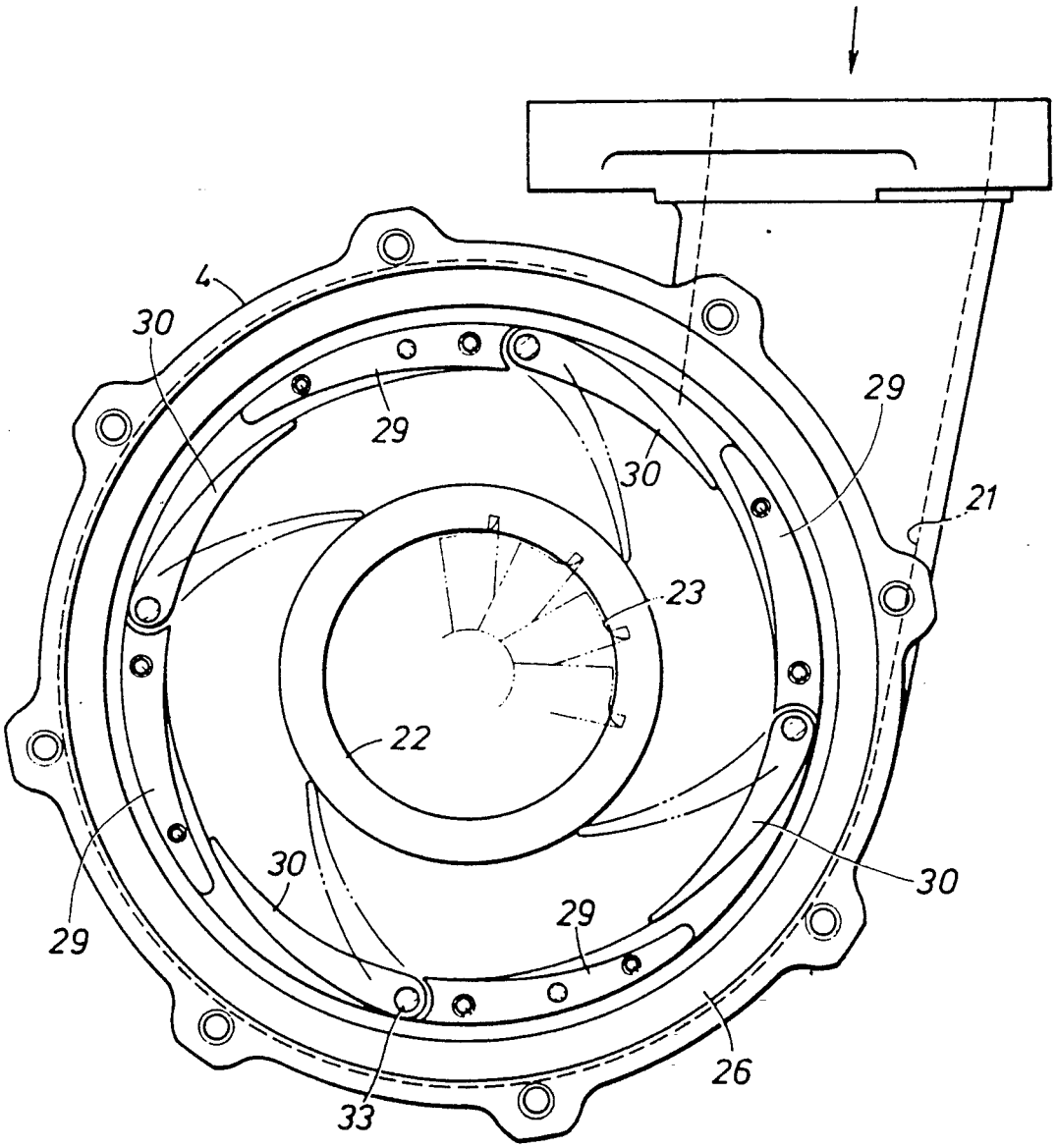
FIG. 2 is a sectional view taken along line II—II of FIG. 1.

This variable are nozzle unit 28 may consist of, for instance, the one disclosed in copending U.S. Pat. Application No. 054,499 filed May 27, 1987, and, as shown in FIG. 2, comprises four arcuate fixed vanes 29 and four arcuate movable vanes 30 arranged along a circle concentric to the turbine wheel and in an alternating manner. Axial ends of the fixed vanes 29 are integrally connected to radially projecting annular wall portion 31 of the turbine casing 4 which outwardly extend from the partition wall 4 into the second scroll passage 26 substantially in parallel with the back plate 20, while the other axial ends of the fixed vanes 29 are attached to the back plate 20 by means of threaded bolts 32 which are passed through the back plate 20 into the fixed vanes 29.

The movable vanes 30 are rotatably supported, at their leading edges, by pivot pins 33 which are passed through the back plate 20 in such a manner that a variable area nozzle is defined between the trailing edge of each of the movable vanes 30 and the leading edge of the adjacent fixed vane 29. The external ends of the pivot pins 33 projecting from the rear surface of the back plate 20 are coupled to external drive means 52 via a linkage mechanism 34 for rotating the movable vanes 30 around the pivot pins 33. The drive means 52 is also controlled by the control unit 53. The movable vanes 30 are adapted to swing between their fully closed positions where they align with the fixed vanes 29 along the circumferential direction to define a minimally open nozzle gap $g_{min}$ therebetween and the fully open positions where the trailing edges of the movable vanes 30 are located in the immediate vicinity of the periphery of the turbine wheel 23 to define most open condition of the nozzles.

Now the operation of this variable capacity, twin scroll turbine is described in the following.

In low speed range and the idle condition of the engine, the control valve 27 completely closes the second scroll passage 26. Therefore, the exhaust gas is conducted to the turbine wheel 23 through the first scroll passage 25 only. The first scroll passage 25 has a smaller cross-section than the second scroll passage 26 and has a small A/R value with the result that the turbine wheel 23 can be driven even with a small exhaust gas flow rate, and a sufficient degree of supercharging can be attained even in low speed range of the engine.

When the rotational speed of the engine has exceeded a certain predetermined value Ne, the control valve 27 is fully opened. As a result, the exhaust gas is conducted to the turbine wheel 23 through both the first and second scroll passages 25 and 26. At this time point, the movable vanes 30 are at their substantially closed positions, and there is no abrupt change in the speed of the exhaust gas directed to the turbine wheel 23. This predetermined value Ne corresponds to the intercept value at which the degree of supercharging stops increasing even when the flow rate of the exhaust gas keeps increasing with the control valve 27 in the fully closed state.

As the rotational speed of the engine increases, the movable vanes 30 are progressively opened according to the increase in the flow rate of the exhaust gas to reduce the flow resistance in the turbine and prevent the reduction in the engine efficiency.

Alternatively, the control valve 27 may be omitted so that the flow of exhaust gas through the second scroll passage 26 may be controlled exclusively by the annular variable nozzle unit 28. In this case, the variable nozzle unit 28 is kept in its most closed state and the exhaust gas flow is conducted substantially only by the first scroll passage 25 until the rotational speed of the engine reaches the aforementioned predetermined value Ne. Once the rotational speed of the engine has exceeded the predetermined value Ne, the variable nozzle unit 28 is controlled so as to achieve the optimum speed of the exhaust gas directed to the turbine wheel 23.

Figure 3:
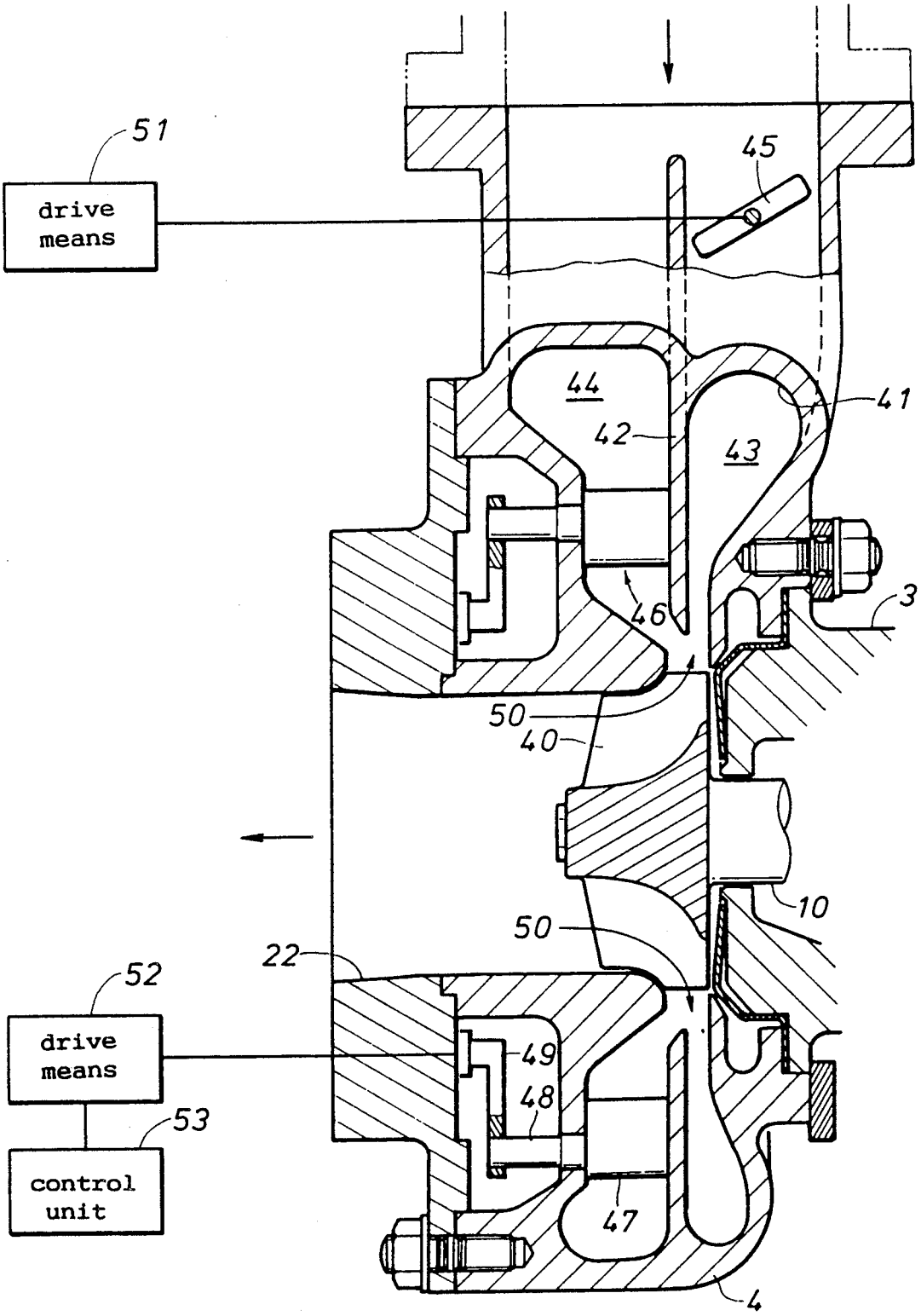
FIG. 3 is a fragmentary sectional view showing a second embodiment of the present invention.

FIG. 3 shows a second embodiment of the present invention. According to this embodiment also, the scroll passage 41 defined around the turbine wheel 40 is divided into a first scroll passage 43 and a second scroll passage 44, which are parallel to each other, by a partition wall 41. The inlet end of the first scroll passage 43 is provided with a control valve 45 which is activated by external drive means 51 for selectively closing the inlet to the first scroll passage 43. The drive means 51 is in turn controlled by a control unit 53. In the annular outlet region of the second scroll passage 44 around the turbine wheel 40, externally of a throat section 50 defined as an annular region having a locally minimum cross section, is provided a variable area nozzle unit 46 similar to the variable area nozzle unit 28 of the previous embodiment. The variable area nozzle unit 46 is provided with movable vanes 47 which define variable area nozzles in cooperation with adjacent movable vanes 47 or, alternatively, fixed vanes (not shown in the drawings). For possible variations of the variable area nozzle unit, reference is made to copending U.S. Pat. Application No. 310,357, filed Feb. 13, 1989, now U.S. Pat. No. 4,867,637, issued Sept. 19, 1989, which is assigned to the same assignee and discloses variable area nozzle units using exclusively moveable vanes and a combination of fixed vanes and movable vanes, respectively. The movable vanes 47 are pivotally supported by pivot pins 48 at their leading edges, and the external ends of these pivot pins 48, which project towards the front end of the turbine in the present embodiment, are coupled, via a linkage mechanism 49, to external drive means 52 which is in turn controlled by the control unit 53.

Now the operation of the second embodiment is described in the following with reference to FIG. 3.

When the engine is idling or running at low speed, the control valve 45 substantially completely closes the first scroll passage 43. The variable are nozzle unit 46 is in most closed condition when the engine is idling, and opens its nozzles progressively as the rotational speed of the engine increases to adjust the speed of the exhaust gas directed to the turbine wheel to an optimum level. When the flow rate of the exhaust gas has sufficiently increased and the variable area nozzle unit 46 has fully opened up its nozzles, the control valve 45 opens up the first scroll passage 43. In this way, by increasing the effective cross-sectional area of the passage leading to the turbine wheel 40 by opening the control valve 45, the turbine can maintain its operation without unduly increasing the back pressure at its inlet end even when the rotational speed of the engine is high and the flow rate of the exhaust gas is accordingly large. The control valve 45 may be opened up either gradually or abruptly as desired, and even when it is opened abruptly, since the flow rate is already substantially large, there will be caused no significant shock.

Thus, according to the present invention, by combining a twin scroll structure and a variable nozzle unit structure, the effective range of the flow rate of the turbine can be expanded. In particular, when this turbine is used as the exhaust turbine of a turbocharger, a high degree of supercharging can be obtained even from low speed range of the engine, and can achieve a high degree of supercharging in high speed range of the engine without creating excessive back pressure in the exhaust system of the engine or involving any shocks or lags over the whole speed range.

What we claim is:

1. A variable capacity turbine, comprising:

a casing defining a first scroll passage, a second scroll passage having a larger cross-sectional flow area than said first scroll passage, said second scroll passage having a central part which is common to the first scroll passage, and an axial passage communicated with said common central part of said scroll passages;

a turbine wheel rotatably arranged in said common central part of said scroll passages; and a plurality of variable area nozzles arranged in a part of said second scroll passage adjacent to and surrounding said common central part.

2. A variable capacity turbine as defined in claim 1, further comprising control means for controlling the opening of said variable area nozzles for producing a minimally open state of said variable area nozzles when the flow rate of working fluid is less than a certain prescribed value, and increasing the size of opening of said variable area nozzles according to an increasing flow rate of said working fluid when said flow rate is greater than said prescribed value.

3. A variable capacity turbine as defined in claim 2, wherein a control valve is provided at an inlet end portion of said second scroll passage and is operable to close said scroll passage when said flow rate is less than said prescribed value.

4. A variable capacity turbine as defined in claim 1, further comprising a control valve provided at an inlet end portion of said first scroll passage; and control means for closing said control valve and adjusting the size of said variable area nozzles according to the flow rate of working fluid when said flow rate is less than a certain prescribed value, and for opening said control valve and maintaining a maximally open state of said variable area nozzles when the flow rate of said working fluid is greater than said certain prescribed value.

5. A variable capacity turbine as defined in claim 1, 2, 3 or 4 which has the first and second scroll passages adapted for connection to an exhaust gas outlet of an automobile internal combustion engine for use as the exhaust turbine of a turbocharger for the automotive internal combustion engine.

6. A variable capacity turbine, comprising:

a casing defining a first scroll passage, a second scroll passage having a larger cross section than said first scroll passage and having a radially central part which is common to said first scroll passage, and an axial passage communicating with said common central part of said scroll passages;

a turbine wheel rotatably arranged in said common central part of said scroll passages;

a plurality of variable area nozzles arranged in a part of said second scroll passage adjacent to and surrounding said common central part;

control means for producing a minimally open state of said variable area nozzles when the flow rate of working fluid is less than a certain prescribed value, and adjusting the size of said variable area nozzles according to the flow rate of said working fluid when said flow rate is greater than said prescribed value; and a control valve provided at an inlet end portion of said second scroll passage to close said second scroll passage when said flow rate is less than said prescribed value.

* * * * *

UNITED STATES PATENT AND TRADEMARK OFFICE

CERTIFICATE OF CORRECTION

PATENT NO. : 5,092,126

DATED : March 3, 1992

INVENTOR(S) : S. Yano

It is certified that error appears in the above-identified patent and that said Letters Patent is hereby corrected as shown below:

IN THE CLAIMS:

Claim 5, column 6, line 43, delete "automobile" and insert -- automotive --.

Signed and Sealed this

Twenty-sixth Day of October, 1993

*Attest:*

*Attesting Officer*

Bruce Lehman

BRUCE LEHMAN

*Commissioner of Patents and Trademarks*